US007030573B2

(12) United States Patent
Powell

(10) Patent No.: US 7,030,573 B2
(45) Date of Patent: Apr. 18, 2006

(54) HIGH INTENSITY DISCHARGE STROBE LAMP ASSEMBLY AND METHOD FOR PRODUCING ATTENUATED-EMI STROBE ILLUMINATION

(75) Inventor: John Eddie Powell, Newport, NH (US)

(73) Assignee: Luminescent Systems, Inc., Lebanon, NH (US)

( * ) Notice: Subject to any disclaimer, the term of this patent is extended or adjusted under 35 U.S.C. 154(b) by 0 days.

(21) Appl. No.: 10/827,821

(22) Filed: Apr. 20, 2004

(65) Prior Publication Data

US 2005/0231132 A1 Oct. 20, 2005

(51) Int. Cl.
*H05B 37/02* (2006.01)

(52) U.S. Cl. ..... 315/291; 315/294

(58) Field of Classification Search ..... 315/291, 315/294, 209 R, 212, 76, 77, 79
See application file for complete search history.

(56) References Cited

U.S. PATENT DOCUMENTS 3,576,468 A * 4/1971 Walker ..... 315/209 R
4,095,170 A * 6/1978 Schmitt ..... 324/392
4,422,016 A 12/1983 Kurple
4,469,988 A * 9/1984 Cronin ..... 315/209 R
RE32,341 E 1/1987 Smith
5,530,634 A 6/1996 Smith
5,557,176 A * 9/1996 O'Brien ..... 315/307
6,483,254 B1 * 11/2002 Vo et al. ..... 315/241 S
6,501,231 B1 * 12/2002 Hyland et al. ..... 315/241 S
2005/0012466 A1 * 1/2005 Chen et al. ..... 315/224

OTHER PUBLICATIONS

WEBPAGE, www.aerovisions.com, "XeVision HID Xenon lighting systems for aerospace & inductrial applications", printed Aug. 22, 2005.

* cited by examiner

*Primary Examiner*—Trinh Vo Dinh
(74) *Attorney, Agent, or Firm*—Steven J. Hultquist; Vincent K. Gustafson; Intellectual Property Technology Law

(57) ABSTRACT

A high intensity discharge (HID) strobe lamp assembly including an HID lamp and circuitry arranged to maintain a current flow to the arc gap of the lamp throughout the powered operation of the lamp during strobing emissions as well as non-strobing operation. The lamp assembly thereby avoids problems incident to turn-on of the lamp for strobing emissions in prior lamps, in which long delay times between successive strobe emissions are necessary or high turn-on voltages are needed to flash the lamp. The lamp assembly of the invention avoids the requirement of long relaxation periods between successive strobe events and the need for high voltage conditions for strobing of the lamp, so that the lamp is able to operate in an efficient manner without generating EMI in the MegaHertz-GigaHertz range.

30 Claims, 3 Drawing Sheets

HIGH INTENSITY DISCHARGE STROBE LAMP ASSEMBLY AND METHOD FOR PRODUCING ATTENUATED-EMI STROBE ILLUMINATION

BACKGROUND OF THE INVENTION

1. Field of Invention

The present invention generally relates to high intensity discharge (HID) lamps and more specifically to a high intensity strobe lamp assembly and method that produces strobe illumination without electromagnetic interference (EMI).

2. Brief Description of the Related Art

By way of background to the ensuing discussion of the related art to the present invention, and in connection with the description of the invention hereinafter, set out below is a glossary of relevant terminology.

As used herein, a "high intensity discharge (HID) lamp" means a lamp using a ballast to generate an electrical charge and to regulate voltage and current, which produces illumination when an arc of electrical energy passes across an arc gap, through gas contained in the lamp. Examples of HID lamps include, without limitation, metal halide lamps, compact metal halide lamps, pulse-start metal halide lamps, high pressure sodium lamps, white high pressure sodium lamps, mercury vapor lamps, and low-pressure sodium lamps.

The term "incandescent lamp," as used herein, means a lamp that produces illumination by heating of an internal filament to generate radiant light.

The term "fluorescent lamp," as used herein, means a lamp that uses phosphorus material to produce light when a gas is activated to energize the phosphorus material.

The term "harmful EMI," as used herein, means electromagnetic radiation generated at a frequency≧1 MHz that produces undesirable interference with the operation of electrical/electronic equipment.

The term "continuous current," as used herein in reference to an HID lamp, means an electrical current, e.g., a direct current (DC) or an alternating current (AC), which is uninterrupted across an arc discharge of a HID lamp throughout the powered operation of such lamp.

The term "strobe," as used herein in reference to a lamp, means a lamp that produces intermittent discrete bursts of visible light ("strobing emissions") in a cyclic and repetitive manner, wherein successive bursts are separated by periods of lamp operation with no visible light emission or with light emission that is of substantially lower intensity than the bursts of visible light ("non-strobing operation").

The term "powered operation," as used herein in reference to a strobe lamp, means electronic operation of the strobe lamp producing strobing emissions and non-strobing operation.

The strobing process has been conventionally carried out by cyclically and repetitively turning the power to a lamp on (with current flow to the lamp) and off (with zero currernt flow to the lamp), in an alternating and repetitive cycle.

Many types of lamps have the capability to be operated as strobe lamps. Such lamps include halogen, LED, incandescent, fluorescent and high intensity discharge (HID) lamps. HID lamps are particularly preferred for strobing applications, due to the higher energy efficiency of HID lamps (lumens emitted per watt of input power) than other lamps.

HID lamps, however, have a significant disadvantage in strobe operation. Once the arc discharge of the HID lamp is disrupted during turn-off of the current to the lamp, the lamp cannot restart without a significant time delay, which may in some cases be as long as one minute, unless a high voltage (e.g., on the order of 30 kV–50 kV) is applied to the lamp. When such high voltage is applied to a non-powered HID lamp, however, electromagnetic interference (EMI) signals are generated in the MHz and GHz range. Because most electronic devices operate in the MHz and GHz range, the EMI that is generated (in turn-on of the HID lamp by impressing high voltage thereon) can cause damage to or malfunction of electronic devices that are in proximity to the HID lamp EMI source.

The prior art metal halide strobe light systems that produce such deleterious EMI effects include the metal halide lamp strobe system of U.S. Pat. No. 6,501,231, wherein high voltage power, e.g., at 30 kV, is cyclically applied to the lamp to produce strobing action.

Such lamps as a result of their high-EMI output cannot be utilized in environments containing sensitive electrical/electronic equipment whose operation would be compromised by EMI exposure.

Environments of such type include aircraft environments in which HID strobe lamps as a result of their luminous intensity are highly desirable for exterior lighting of the aircraft, but in which sensitive avionics equipment are susceptible to malfunction and failure as a result of the deleterious EMI radiated by these lamps during their switch-on.

Efforts have been made in the prior art to reduce EMI from HID lamps by shielding approaches. For example, U.S. Pat. No. 5,530,634 describes a shielding arrangement in which an EMI-emissive area is covered with a metal foil. Shielding, however, increases the cost and complexity of the lamp system, is labor-intensive to install, and is susceptible to deterioration and mechanical failure, with consequent adverse effect on electrical/electronic equipment in the environment of the EMI-emitting HID lamp.

There is therefore a continuing need in the art for HID lamps that are free of deleterious EMI effects.

SUMMARY OF THE INVENTION

The present invention relates to a high intensity strobe lamp assembly and method that produces strobe illumination without deleterious electromagnetic interference (EMI).

In one aspect, the invention relates to a high intensity discharge strobe lamp assembly, comprising a high intensity discharge lamp having an arc gap that is energizable for strobing emission, and circuitry that is constructed and arranged to (i) deliver power to the high intensity discharge lamp from a power supply for powered operation including strobing emissions and non-strobing operation, (ii) supply current continuously to the arc gap of the high intensity discharge lamp during said powered operation so that a flux of electrons across the arc gap is maintained during said strobing emissions as well as said non-strobing operation, and (iii) generate no deleterious EMI during said powered operation.

In another aspect, the invention relates to a high intensity discharge strobe lamp assembly as described in the preceding paragraph, operatively coupled with a power supply for said powered operation, and disposed at a location in proximity to electrical and/or electronic equipment that would produce electromagnetic interference with said equipment if deleterious EMI were generated at said location.

A further aspect of the invention relates to a vehicle including electrical and/or electronic equipment susceptible to electromagnetic interference from deleterious EMI, and a high intensity discharge strobe lamp assembly as described hereinabove.

Yet another aspect of the invention relates to a structural installation including electrical and/or electronic equipment susceptible to electromagnetic interference from deleterious EMI, and a high intensity discharge strobe lamp assembly as described hereinabove.

A still further aspect of the invention relates to a method of producing strobe illumination from a high intensity discharge lamp having an arc gap that is energizable for strobing emission, said method comprising (i) delivering power to the lamp for powered operation including strobing emissions and non-strobing operation, (ii) supplying current continuously to the arc gap of the high intensity discharge lamp during such powered operation so that a flux of electrons across the arc gap is maintained during the strobing emissions as well as the non-strobing operation, and (iii) generating no deleterious EMI during such powered operation.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
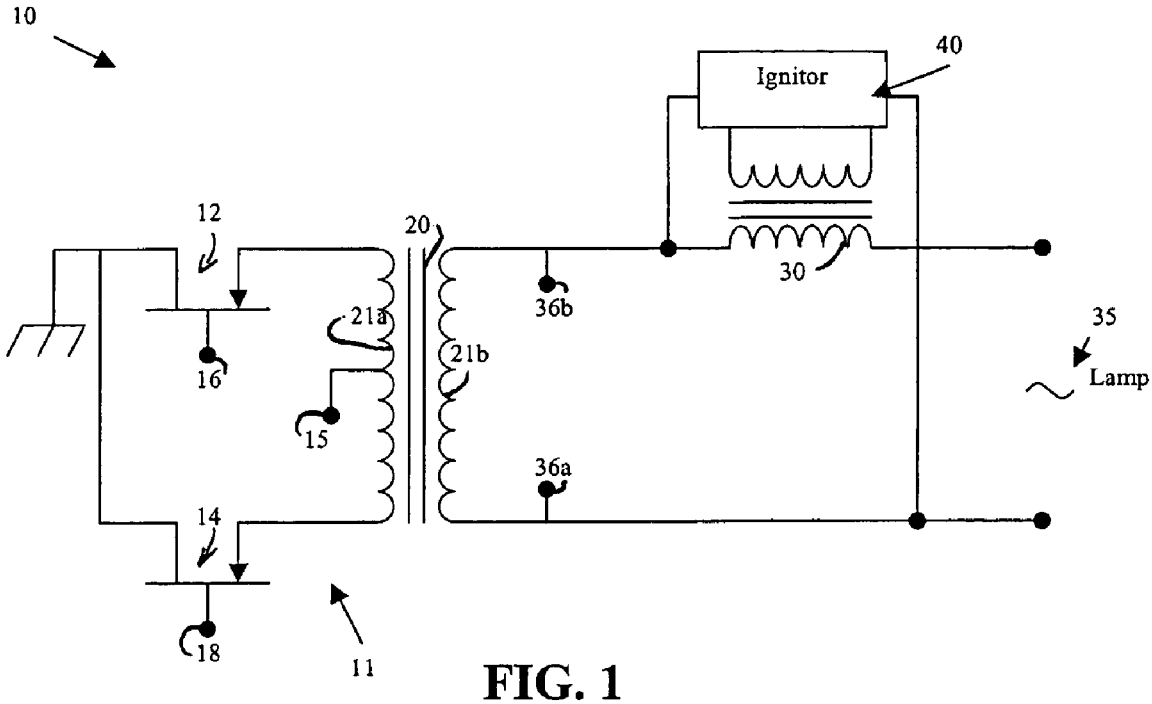
FIG. 1 is a circuit diagram of a high intensity discharge strobe lamp assembly according to one embodiment of the present invention.

The present invention relates to a high intensity discharge strobe lamp assembly that produces strobe illumination without the incidence of EMI emissions that have limited the utility of prior art HID strobe lamps in EMI-sensitive applications.

In one preferred embodiment, the HID strobe lamp assembly of the present invention is utilized for exterior aircraft lighting applications, to provide high-visibility strobe illumination during operation of the aircraft, without adverse impact of EMI effects on the on-board avionics instrumentation of such aircraft, e.g., navigational and communications systems, fuel and engine monitoring equipment, electromechanical systems for landing gear and aircraft control surface elements, telemetry systems, etc.

The present invention is based on the discovery that a current may be applied continuously to the arc gap of a high intensity discharge strobe lamp, throughout the powered operation of the lamp including strobing emissions and non-strobing operation, so that a flux of electrons is maintained across the arc gap during the intervals of powered operation when strobing emissions are not being actively generated by the lamp assembly.

By maintaining an electron flux across the arc gap during non-strobing periods of powered operation, a substantially reduced voltage, typically below 1500 volts, is required to energize the lamp for production of strobing emissions. By way of example, an HID lamp assembly of the present invention may be operated with a turn-on voltage for strobing emission on the order of about 1000 volts, rather than the 30 kV–50 kV levels that are required for turn-on of strobing emission in conventional HID strobe lamp assemblies. As a result of such reduction of the level of the energizing voltage for initiating strobe emission, a lamp assembly of the invention operating at a strobing emission turn-on voltage of 1000 volts exhibits no EMI in the megaHertz-gigaHertz spectrum.

In a specific embodiment of the invention, the control circuitry for the HID strobe lamp assembly includes a dimmer circuit that is constructed and arranged to dim the HID lamp when an input signal having a low duty cycle is applied to the lamp, e.g., an input signal with a 10–20% duty cycle, and to produce strobing emission when an input signal having a high duty cycle is applied to the lamp, e.g., an input signal having a 50% duty cycle, wherein the low duty cycle and high duty cycle operations are alternatingly and repetitively carried out for powered operation of the HID lamp to produce strobe illumination, without generating deleterious EMI.

In another specific embodiment of the invention, the HID strobe lamp assembly includes circuitry that is constructed and arranged to generate strobe illumination and provide continuous current to the arc gap of an HID lamp. Such circuitry includes a first circuit that when switched on ignites and provides continuous current to the lamp, maintaining the lamp in a dimmed powered operation (non-strobe operation) state. The circuitry is arranged so that the first circuit then is switched off and a second circuit of the circuitry is switched on. The second circuit flashes the lamp by applying a higher voltage sufficient to generate strobe emissions from the lamp, while maintaining flow of continuous current to the lamp. Following the flashing of the lamp by the second circuit, the second circuit is switched off and the first circuit again is switched on, and the cycle then is continued, in an alternating and repeating manner, of powered operation involving strobe emission followed by non-strobe operation, followed by strobe emission, etc., to provide sustained strobe illumination without the incidence of deleterious EMI.

Specific features and aspects of the invention will be more fully appreciated by the ensuing discussion of illustrative aspects, features and embodiments of the invention.

Referring now to the drawings, FIG. 1 is a circuit diagram of a high intensity discharge strobe lamp assembly according to one embodiment of the present invention.

The HID strobe lamp assembly of FIG. 1 includes a circuit 10 having an input source 15, which is center-tapped to input windings 21*a* of transformer 20, to supply an alternating current (AC) signal to the input windings of such transformer. The alternating current signal can be of any suitable waveform, e.g., a sine wave, square wave, ramp function, or other variable waveform. The input source may comprise any suitable power supply, selected from among power supplies of varying types that are well-known in the illumination art, and require no specific description herein.

When the alternating current signal is varied, the two mosfets 12 and 14 alternatingly and repetitively turn on and off in reciprocal relationship to one another, so that while one of such mosfets is on, the other is off. In this circuit, when the input voltage is at a high stage, mosfet 12 is on and mosfet 14 is off. In such configuration, the current will flow through the input windings 21*a* of transformer 20. When the input voltage is at a low stage, mosfet 14 is on and mosfet 12 is off, causing the current to reverse direction. The input source, mosfets and associated transformer thus form a push-pull circuit 11 generating an alternating current.

Figure 2:
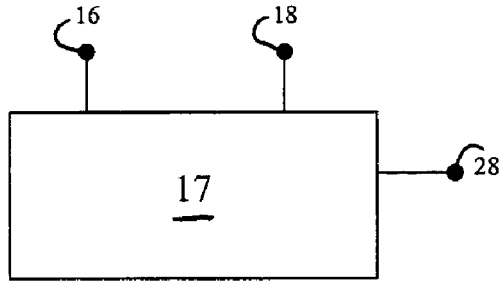
FIG. 2 is schematic representation of inputs and outputs to a digital logic unit utilized in connection with the circuitry of FIG. 1.

FIG. 2 is schematic representation of inputs and outputs to a digital logic unit 17 utilized in connection with the circuitry of FIG. 1. Voltages at gate 16 of mosfet 12 and at gate 18 of mosfet 14 of the push-pull circuit 11 are controlled by logic unit 17 featuring voltage monitoring node 28, discussed more fully hereinafter. The logic unit 17 may be controlled by a computer, microprocessor, central processing unit (CPU), or other logic controller, to effect the powered operation of the FIG. 1 lamp assembly, including alternating strobe emission and non-strobe operation steps of the repeating strobe cycle.

Referring again to the FIG. 1 schematic diagram, the alternating current generated by the push-pull circuit 11 is transferred to the output windings 21*b* of the voltage transformer 20 and passed to the HID lamp 35 to energize the lamp for illumination.

An ignitor circuit 40, having transformer 30 associated therewith, connects across the lamp 35 for ignition thereof. A switch (not shown in FIG. 1 for clarity) may be placed in series with the ignitor circuit 40 to permit switching-on and switching-off of the ignitor circuit.

When the input source 15 has a high state, e.g., a 50% duty cycle, the power transformed from the input windings 21*a* to the output windings 21*b* of transformer 20 will transfer power to the lamp 35 for strobe emission, and when the input source 15 has a low state, e.g., a 10–20% duty cycle, the lamp is dimmed for non-strobing powered operation.

Thus, to effect powered operation of the lamp, involving repeating cycles of sequential strobing emission and non-strobing operation, the duty cycle of the input signal is intermittently varied from the low state to the high state, e.g., from a low state duty cycle of about 10–20% to a high state duty cycle of about 50–60%.

During powered operation, the lamp receives continuous current, i.e., electron flow across the arc gap of the lamp is not disrupted, but continues through both of the repeating steps of strobing emission and non-strobing operation.

The circuitry shown in FIG. 1 optionally may employ a feedback circuit as hereinafter described in connection with FIG. 6 hereof, connected at nodes 36*a* and 36*b* of the HID strobe lamp assembly, for enhanced stability of operation.

Figure 3:
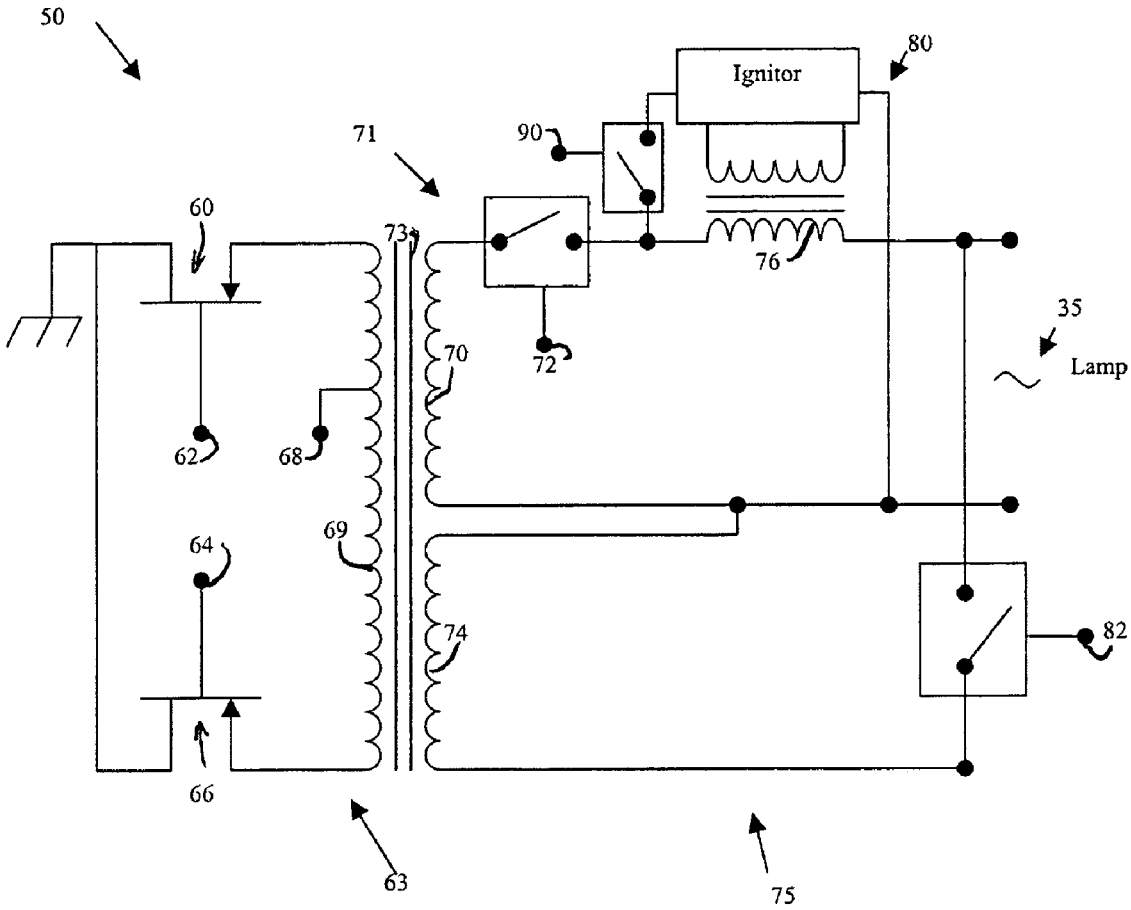
FIG. 3 is a circuit diagram of a high intensity discharge strobe lamp assembly according to another embodiment of the present invention.

FIG. 3 is a circuit diagram of a high intensity discharge strobe lamp assembly according to another embodiment of the present invention, featuring a high intensity discharge lamp 35. However, instead of intermittently dimming the lamp 35 between successive strobing emissions, as in the assembly of FIG. 1, the lamp assembly of FIG. 3 is arranged for switching of a simmer circuit 75 to apply a suitable voltage to the lamp, e.g., a voltage of 1 kV, for flashing thereof.

The circuit of FIG. 3, like that of FIG. 1, employs a push-pull circuit 63 for providing an alternating current to the input windings 69 of a voltage transformer 73. The voltage transformer 73 has dual output windings 70 and 74. Such transformer may have any suitable winding structure, e.g., a ratio of 1:20 of input windings 69 to output windings 74, and a suitable lower ratio of input windings 69 to output windings 70. Because of the greater number of turns in output windings 74 than in output windings 70, a higher power level will be transmitted to the lamp 35 by output windings 74 than by output windings 70.

The circuitry in FIG. 3 includes the simmer circuit 75 connecting the output windings 70 with the lamp 35. The simmer circuit 75 may be arranged to apply a suitable voltage across the lamp when the simmer circuit is actuated, e.g., a voltage on the order of about 1 kV.

The simmer circuit 75 includes a switch 82 that is in series with output windings 74 and the lamp 35, and is selectively actuatable to turn the simmer circuit 75 on and off, depending on the closed or open character of the switch, respectively.

The switch 82 generally may be of any suitable type, including, without limitation, electrical switches, transistors, diodes, digital logic, and relays.

Dimmer circuit 71 connects output windings 70 with the lamp 35. The dimmer circuit 71 when actuated applies a suitable voltage, e.g., a voltage on the order of 100 volts, on the lamp 35.

The dimmer circuit 71 includes switches 72 and 90 and the ignitor circuit 80.

Switch 72 is in series with the output windings 70 and the ignitor circuit 80, and functions to electrically connect or disconnect the windings 70 to the ignitor circuit 80 and the lamp 35.

Ignitor circuit 80, similar to ignitor circuit 40 of FIG. 1, functions to initially ignite the lamp 35. It is desirable to electrically disconnect the ignitor circuit 40 from the simmer circuit 75 when the simmer circuit is on, because power from the simmer circuit may damage the ignitor circuit.

Switch 90 is in series with the ignitor, and functions to electrically connect the ignitor circuit 80 to, or disconnect it from, simmer circuit 75, dimmer circuit 71 and the lamp 35.

Neither switch 72 nor 90 is concurrently closed when switch 82 is closed because both circuits 71 and 75 deliver power to the lamp 35. Thus, when switches 72 and 90 are closed, switch 82 is open, and vice versa.

When switches 72 and 90 are closed, windings 70 and the ignitor circuit 80 are electrically connected to lamp 35. This will apply a continuous current, e.g., of about 0.5 amps, and voltage, e.g., of about 100 volts, to the lamp 35. When switches 72 and 90 are closed, switch 82 is open, to electrically disconnect the windings 74 from the lamp 35.

When switch 82 is closed, switches 72 and 90 are open. Thus, windings 70 and the ignitor circuit 80 are electrically disconnected from the lamp 35, while a voltage, e.g., of about 1 kV, and current, e.g., in a range from about 10–30 mA, from output windings 74 are applied to lamp 35. This switching of electrical power does not disrupt the arc discharge of the lamp 35. Additionally, because there has been continuous current flow to the lamp and the arc discharge of the lamp has not been disrupted, such application of power to the lamp, e.g., a voltage of 1 kV and a current of 10–30 milliamps, will cause the lamp to flash for strobing emission without delay.

Figure 4:
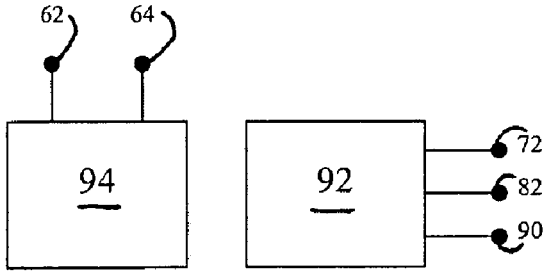
FIG. 4 is a schematic representation of inputs and outputs to a digital logic unit utilized in connection with the circuitry of FIG. 2.

FIG. 4 is a schematic representation of inputs and outputs to a digital logic unit utilized in connection with the circuitry of FIG. 3.

Logic unit 92, shown in FIG. 4, functions to control switches 82, 72 and 90 to effect flashing of the HID lamps in a cyclic and repetitive manner. A computer, microprocessor, central processing unit (CPU), or other logic controller, controls the logic unit 92 automatically for continuity of the strobing emissions during the powered operation of the lamp assembly.

Similar to the gate voltages 16 and 18 of the lamp assembly schematically depicted in FIG. 1, gate voltages 62 and 64 of mosfets 60 and 66 in the push-pull circuit 63 of FIG. 3 are controlled by logic unit 94, as schematically shown in FIG. 4. The logic unit 94 may likewise be controlled by a computer, microprocessor, central processing unit (CPU), or other logic controller.

Figure 5:
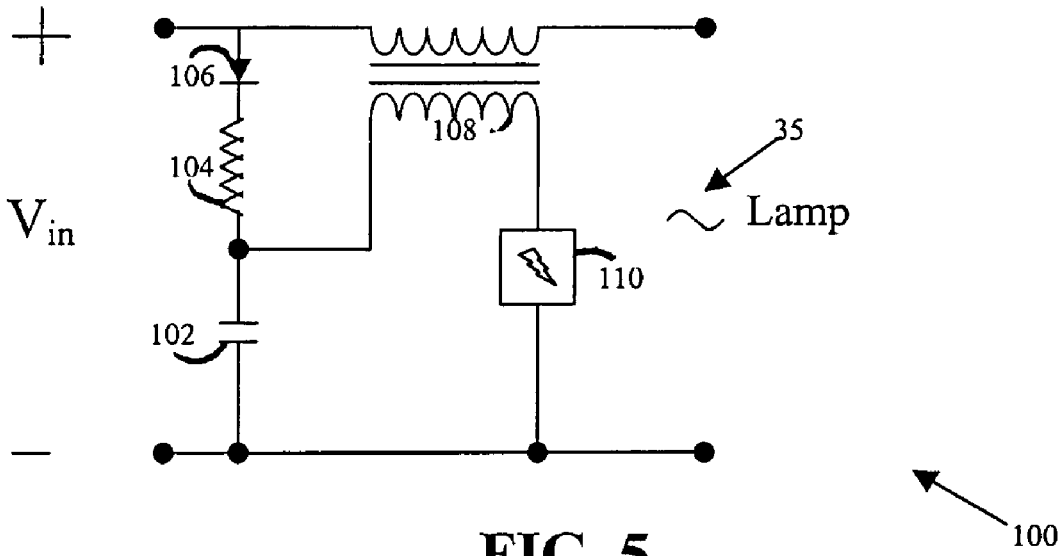
FIG. 5 is circuit diagram of an illustrative ignitor circuit that may be usefully employed in a strobe lamp assembly in accordance with the invention.

FIG. 5 is circuit diagram of an illustrative ignitor circuit that may be usefully employed in a strobe lamp assembly in accordance with the invention.

In the FIG. 5 ignitor circuit, step-up transformer 108 is analogous to the step-up transformer 30 shown in the lamp assembly of FIG. 1 and step-up transformer 76 in the lamp assembly of FIG. 3. The step-up transformer is arranged as shown with respect to the line containing capacitor 102, resistor 104 and diode 106 in series with one another. A spark gap 110, arranged for spark generation at a selected voltage, e.g., of 300 volts, functions to ignite the lamp after voltage $V_{in}$ is inputted to the circuit.

Figure 6:
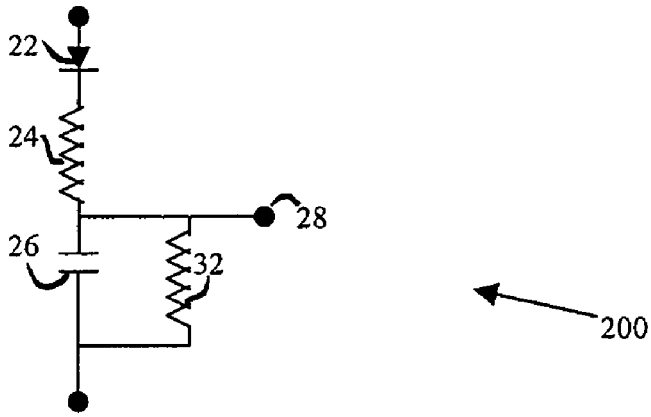
FIG. 6 is a circuit diagram of feedback circuitry for a high intensity discharge strobe lamp assembly, according to a further aspect of the invention.

To ensure stability of the ignitor circuit, a feedback circuit 200, as shown in FIG. 6, may be employed across nodes 36*a* and 36*b* of the lamp assembly of FIG. 1. The feedback circuit 200 includes a series arrangement of diode 22, resistor 24 and capacitor 26 in a line coupled by a branch line containing resistor 32 to the node monitoring line terminating in voltage monitoring node 28. Diode 22 converts the alternating current signal to a direct current signal. This allows for the voltage monitoring node 28 to deliver, as feedback, a voltage to digital logic unit 17, as shown in FIG. 2. Based on this feedback voltage, digital logic unit 17 responsively adjusts the signal to the mosfet gates 16 and 18.

The logic units in the lamp assembly embodiments illustratively described hereinabove may be of any suitable type, and may be operatively arranged in any suitable manner to effect the powered operation of the HID strobe lamp in the lamp assembly involving a repetitive sequence of strobing emission and non-strobing operation steps, whereby flashing of the strobe lamp occurs without deleterious EMI emission.

As a result, the HID strobe lamp assembly of the invention can be used in applications and end-use environments containing sensitive electrical/electronics equipment which would otherwise be susceptible to interference, malfunction and failure from deleterious EMI if conventional HID strobe lamps were employed.

The invention therefore contemplates the deployment of HID strobe lamp assemblies on aircraft and on and/or within other vehicles and structural installations containing or including EMI-sensitive electrical/electronic componentry and equipment, without impediment to the operation of such componentry and equipment.

It will be apparent from the foregoing that the HID strobe lamp assembly of the invention provides a simple and readily fabricated device for strobe illumination that avoids the need of the prior art for long delay periods between successive strobing emissions of an HID lamp, or the high voltage turn-on conditions that are otherwise necessary to initiate strobing emissions and that concurrently produce deleterious EMI. By providing a strobe lamp assembly that is characterized by short periods of non-strobing operation between successive bursts of strobing emissions, with low-voltage operation, and an absence of any deleterious EMI, the present invention achieves a substantial advance in the art of strobe illumination.

While the invention has been described herein with reference to specific features and illustrative embodiments, it will be recognized that the utility of the invention is not thus limited, but rather extends to and encompasses other features, modifications and alternative embodiments as will readily suggest themselves to those of ordinary skill in the art based on the disclosure and illustrative teachings herein. The claims that follow are therefore to be construed and interpreted as encompassing all such features, modifications and alternative embodiments within their spirit and scope.

What is claimed is:

1. A high intensity discharge strobe lamp assembly, comprising a high intensity discharge lamp having an arc gap that is energizable for strobing emission, and circuitry that is constructed and arranged to (i) deliver power to the high intensity discharge lamp from a power supply for powered operation including strobing emissions and non-strobing operation, (ii) supply current continuously to the arc gap of the high intensity discharge lamp during said powered operation so that a flux of electrons across the arc gap is maintained during said strobing emissions as well as said non-strobing operation, and (iii) generate no deleterious EMI during said powered operation.

2. The high intensity discharge strobe lamp assembly of claim 1, wherein said circuitry is constructed and arranged to deliver a voltage of less than 1500 volts to the lamp for production of strobing emissions.

3. The high intensity discharge strobe lamp assembly of claim 1, wherein said circuitry is constructed and arranged for non-strobing operation during a low duty cycle power input, and strobing emission during a high duty cycle power input.

4. The high intensity discharge strobe lamp assembly of claim 1, wherein said circuitry comprises a push-pull circuit arranged to generate an alternating current for energizing said lamp at a high stage voltage for strobing emission and at a low stage voltage for non-strobing operation.

5. The high intensity discharge strobe lamp assembly of claim 4, wherein said push-pull circuit includes a transformer arranged for connection to an AC power supply and coupled to first and second mosfets arranged for alternating operation to produce said high stage voltage for strobing emission when said first mosfet is on and said second mosfet is off, and to produce said low stage voltage for non-strobing operation when said first mosfet is off and said second mosfet is on, with said first and second mosfets being coupled with a logic unit for alternating switch-on/switch-off of said first and second mosfets.

6. The high intensity discharge strobe lamp assembly of claim 5, wherein said circuitry further includes an ignitor circuit for initial energizing of said lamp at inception of said powered operation.

7. The high intensity discharge strobe lamp assembly of claim 6, wherein said circuitry further comprises a feedback, circuit arranged to monitor said alternating current generated by said push-pull circuit and responsively generating a feedback signal to said logic unit for modulating said alternating switch-on/switch-off of said first and second mosfets to maintain stable powered operation.

8. The high intensity discharge strobe lamp assembly of claim 1, wherein said circuitry comprises a simmer circuit for applying a first voltage to the lamp, wherein said first voltage is effective to generate said strobing emissions, and a dimmer circuit for applying a second voltage to the lamp, wherein said second voltage is effective to maintain said non-strobing operation with said flux of electrons across the arc gap of the lamp.

9. The high intensity discharge strobe lamp assembly of claim 1, wherein said circuitry comprises a push-pull circuit arranged to generate an alternating current for energizing said lamp, and said push-pull circuit is coupled to said simmer circuit and said dimmer circuit by a transformer including input windings in said push-pull circuit, a first set of output windings in said simmer circuit and a second set of output windings in said dimmer circuit.

10. The high intensity discharge strobe lamp assembly of claim 9, wherein said simmer circuit and said dimmer circuit are switchably arranged far alternating operation, between a switched-on state of the simmer circuit when the dimmer circuit is switched-off, and a switched-on state of the dimmer circuit when the simmer circuit is switched-off.

11. The high intensity discharge strobe lamp assembly of claim 10, wherein said circuitry further includes an ignitor circuit for initial energizing of said lamp at inception of said powered operation.

12. The high intensity discharge strobe lamp assembly of claim 11, wherein said ignitor circuit is switchably connected to said simmer circuit and said dimmer circuit so that the ignitor circuit is electrically disconnectable from the simmer circuit when the simmer circuit is switched-on.

13. The high intensity discharge strobe lamp assembly of claim 10, wherein said simmer circuit and said dimmer circuit are coupled with a logic unit for switching thereof in said alternating operation, between a switched-on state of the simmer circuit when the dimmer circuit is switched-off, and a switched-on state of the dimmer circuit when the simmer circuit is switched-off.

14. The high intensity discharge strobe lamp assembly of claim 1, operatively coupled with a power supply for said powered operation, and disposed at a distance relative to electrical and/or electronic equipment that, wherein a source of deleterious EMI disposed at the same distance relative to the electrical and/or electronic equipment would produce electromagnetic interference with said equipment.

15. A vehicle including electrical and/or electronic equipment susceptible to electromagnetic interference from deleterious EMI, and a high intensity discharge strobe lamp assembly as in claim 1.

16. The vehicle of claim 15, comprising an aircraft.

17. The vehicle of claim 16, wherein said lamp is exteriorly mounted on said aircraft.

18. A structural installation including electrical and/or electronic equipment susceptible to electromagnetic interference from deleterious EMI, and a high intensity discharge strobe lamp assembly as in claim 1.

19. The high intensity discharge strobe lamp assembly of claim 1, wherein the high intensity discharge lamp comprises a metal halide lamp.

20. A method of producing strobe illumination from a high intensity discharge lamp having an arc gap that is energizable for strobing emission, said method comprising (i) delivering power to the lamp for powered operation including strobing emissions and non-strobing operation, (ii) supplying current continuously to the arc gap of the high intensity discharge lamp during said powered operation so that a flux of electrons across the arc gap is maintained during said strobing emissions as well as said non-strobing operation, and (iii) generating no deleterious EMI during said powered operation.

21. The method of claim 20, comprising delivering a voltage of less than 1500 volts to the lamp for production of strobing emissions.

22. The method of claim 20, wherein power to the lamp is delivered from an AC power source, and said method comprises varying a duty cycle of said AC power source for non-strobing operation during a low duty cycle power input, and strobing emission during a high duty cycle power input.

23. The method of claim 20, wherein delivering power to the lamp comprises applying a to the lamp a first voltage effective to generate said strobing emissions during a first period of powered operation, and applying to the lamp a second voltage effective to maintain said non-strobing operation with said flux of electrons across the arc gap of the lamp during a second period of powered operation.

24. The method of claim 23, wherein sequential applications to the lamp of first and second voltage are continued in a repetitive cycle throughout powered operation of said lamp.

25. The method of claim 20, conducted at a location in proximity to electrical and/or electronic equipment that would produce electromagnetic interference with said equipment if deleterious EMI were generated at said location.

26. The method of claim 25, wherein said location comprises a vehicular location.

27. The method of claim 26, wherein said vehicular location comprises a location on or within an aircraft.

28. The method of claim 27, wherein said lamp is exteriorly mounted on said aircraft.

29. The method of claim 25, wherein said location comprises a location of a structural installation.

30. The method of claim 20 wherein the high intensity discharge strobe lamp comprises a metal halide lamp.

* * * * *

UNITED STATES PATENT AND TRADEMARK OFFICE

CERTIFICATE OF CORRECTION

PATENT NO. : 7,030,573 B2
APPLICATION NO. : 10/827821
DATED : April 18, 2006
INVENTOR(S) : John Eddie Powell It is certified that error appears in the above-identified patent and that said Letters Patent is hereby corrected as shown below:

Column 8, line 54, “a feedback,” should be -- a feedback --

Column 9, line 11, “arranged far alternating” should be -- arranged for alternating --

Signed and Sealed this

Thirty-first Day of October, 2006

JON W. DUDAS
*Director of the United States Patent and Trademark Office*